United States Patent [19]

Silverstein

[11] Patent Number: 4,617,735

[45] Date of Patent: Oct. 21, 1986

[54] SAFETY CAP

[75] Inventor: Sidney Silverstein, Flushing, N.Y.

[73] Assignee: Hunt X-ACTO, Inc., Philadelphia, Pa.

[21] Appl. No.: 789,711

[22] Filed: Oct. 21, 1985

[51] Int. Cl.[4] ..... B26B 29/02

[52] U.S. Cl. ..... 30/151; 30/294

[58] Field of Search ..... 30/151, 162, 90, 294, 30/295; 7/167

[56] References Cited

U.S. PATENT DOCUMENTS

| | | | |
|---|---|---|---|
| 868,393 | 10/1907 | Ames . | |
| 1,441,742 | 1/1923 | O'Brien . | |
| 2,288,555 | 6/1942 | St. Jacques | 30/151 |
| 2,320,807 | 6/1943 | Upham | 30/151 |
| 2,336,779 | 12/1943 | Creasy . | |
| 2,390,309 | 12/1945 | Keys . | |
| 3,160,954 | 12/1964 | Martin | 30/294 |
| 3,608,195 | 9/1971 | Levin | 30/162 |
| 3,793,726 | 2/1974 | Schrank | 30/151 |
| 3,977,077 | 8/1976 | Rebold | 30/151 |
| 4,071,952 | 2/1978 | Meshulam et al. | 30/151 |
| 4,359,166 | 11/1982 | Dubach . | |
| 4,442,735 | 4/1984 | Chance et al. | 81/3.44 |

*Primary Examiner*—Jimmy C. Peters

*Attorney, Agent, or Firm*—John F. A. Earley; John F. A. Earley, III

[57] ABSTRACT

A safety cap assembly for a craft knife having a blade and a handle that comprises a cap housing having a front end portion and a rear end portion with an opening at the end of the front end portion for receiving the knife blade, an attaching member located on the front end portion of the housing for attaching it to the knife handle, a sleeve mounted on the housing adapted for sliding back and forth between the front end and the rear end portions of the housing for closing the attaching member in attaching position when the sleeve is at the front end portion of the housing and for opening the attaching member when the sleeve is at the rear end portion, stop members at the ends of the housing for preventing the sleeve from slipping off the housing, and a safety-locking member on the housing for releaseably locking the sleeve in position on the front end portion when the sleeve is closing the attaching member whereby to prevent the cap assembly from opening and being pulled off the knife accidentally.

8 Claims, 6 Drawing Figures

SAFETY CAP

BACKGROUND OF THE INVENTION

1. Field of the Invention

This invention relates to hand-held cutting tools, and more particularly to a safety cap for a hand-held cutting or craft knife.

2. Description of the Prior Art

A typical hand-held craft knife used by hobbyists and craftsmen has a small detachable blade secured to the end of a cylindrical handle. The knife blade rests in a slot in a tapered chuck, and is secured to the knife by tightening a knurled ferrule or sleeve. Because the blade is sharp, it is desirable to cover it when the knife is not in use, and further to cover it with a cap that prevents injury due to accidental exposure to the blade by an adult and also precludes theremoval of the cap by young children.

A protective cap known in the art and disclosed in U.S. Pat. No. 4,071,952 has a plurality of circumferentially spaced inwardly directed longitudinally extending bosses formed on the inside surface of the cap and one or more of the inwardly directed bosses are disposed on a tongue formed by a slot through the wall of the cap which provides a spring action to firmly engage the knurled sleeve of a knife. However, this cap is not locked onto the knife and may be removed simply by pulling on the cap.

SUMMARY OF THE INVENTION

It is an object of this invention to provide a new safety cap assembly for a hand-held cutting knife that covers the blade when the knife is not is use, and further to provide a cap assembly with a safety-lock feature that prevents injury due to accidental removal of the cap assembly and exposure of the blade by an adult or by a child.

These objects are accomplished by providing a safety cap assembly for a hand-held cutting knife with a peripheral or circumferential groove in the handle that comprises a cap housing that has a front end portion and a rear end portion with an opening at the front end portion for receiving a knife blade, attaching means on the front end portion of the housing for attaching it to the knife handle, sleeve means mounted on the housing adapted for sliding back and forth between the front end and the rear end portions for closing the attaching means in attaching position when the sleeve means is at the front end portion of the housing and for opening the attaching means when the sleeve means is at the rear end portion, stop means at the ends of the housing for preventing the sleeve means from slipping off the housing, and safety-locking means on the housing for releasably locking the sleeve means in position on the front end portion when the sleeve means is closing the attaching means whereby to prevent the cap assembly from opening and being pulled off the knife accidentally. The safety cap assembly is secured to a craft knife by attaching the cap assembly to the knife by depressing the attaching means into contact with the knife handle by sliding the sleeve means to the front end portion of the cap housing to close the attaching means in attaching position, and then releasably locking the sleeve means in position on the front end portion by blocking the movement of the sleeve means to the rear end portion with the safety-locking means. The safety cap assembly is removed from the knife by unlocking the sleeve means by depressing the safety-locking means that block the movement of the sleeve means to the rear end portion of the cap housing, releasing the attaching means by sliding the sleeve means to the rear end portion of the cap housing when the locking means are being depressed, and pulling the unlocked and unattached cap housing off the knife.

DETAILED DESCRIPTION

Figure 1:
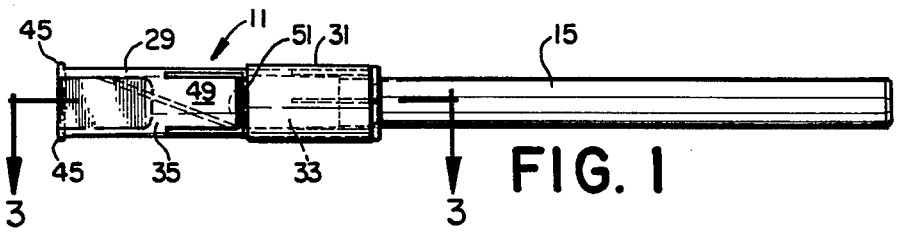
FIG. 1 is a view in elevation of a cutting knife with a safety cap assembly secured to it.
Figure 2:
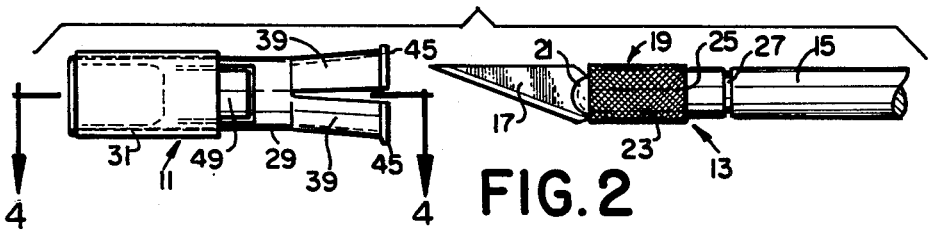
FIG. 2 is a view of the knife and safety cap assembly of FIG. 1 prior to the safety cap assembly being attached to the knife.
Figure 3:
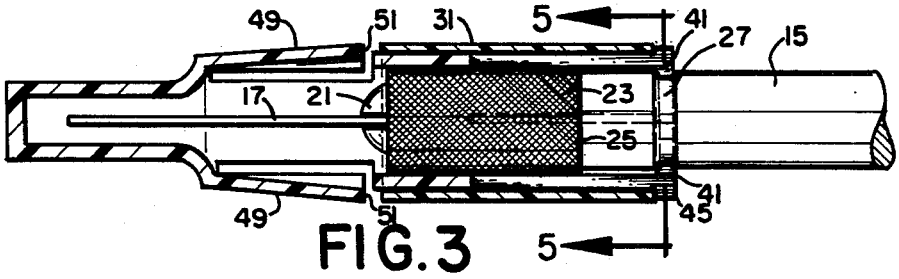
FIG. 3 is an enlarged view in section of the safety cap assembly secured to the knife taken as indicated by the lines and arrows 3—3 of FIG. 1.
Figure 4:
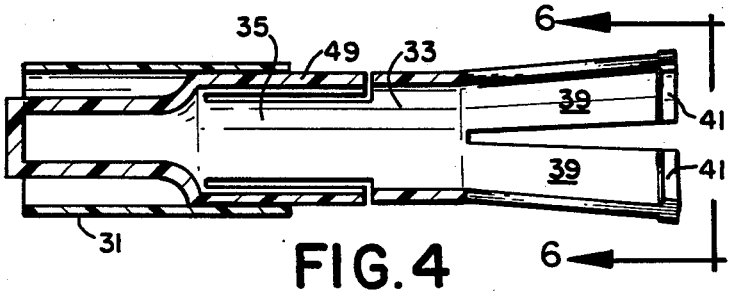
FIG. 4 is an enlarged view in section of the safety cap assembly in an unlocked and an attached position taken as indicated by the lines and arrows 4—4 of FIG. 2.
Figure 5:
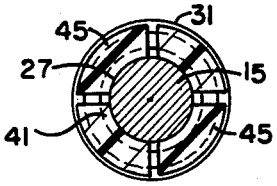
FIG. 5 is a view in cross-section taken as indicated by the lines and arrows 5—5 of FIG. 3.
Figure 6:
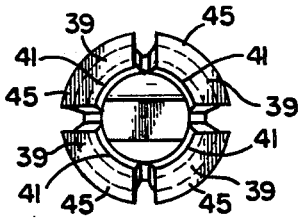
FIG. 6 is an end view taken as indicated by the lines and arrows 6—6 of FIG. 4.

Turning to the drawings, there is shown in FIGS. 1 and 2 a safety cap assembly 11 for a craft or graphic artist knife 13, which comprises a cylindrical handle 15 and a blade 17 that is detachably secured to one end of the handle by a chuck 19. Chuck 19 includes a conical slotted collet 21, that is threaded into the end of handle 15, and a knurled sleeve 23 that engages a shoulder 25 on handle 15 and co-acts with collet 21 when handle 15 is turned relative to knurled sleeve 23 to compress collet 21 and firmly hold blade 17 in place. Handle 15 has a circumferential groove 27.

Safety cap assembly 11 includes a cap housing 29 that is adapted to be mounted on the knife 13 to protect the blade 17, and a sleeve 31 that is mounted on cap housing 29 to attach the housing to knife 13.

Cap housing 29 is preferably formed of a transparent plastic material such as Lexan, as by injection molding, and has an open front end portion 33 with a circular cross-section and a rear end portion 35 of rectangular cross-section, the two portions 33, 35 being of substantially the same length. In the commercial embodiment, rear end portion 35 is closed.

Located on front end portion 33 of cap housing 29 are spring fingers 39 for attaching cap housing 29 to handle 15. Inturned flanges 41 extend from the ends of spring fingers 39 and are adapted to grasp handle 15 of the knife 13.

Stop shoulders 45 are provided that extend outwardly from each end of the housing 29 to prevent sleeve 31 from sliding off housing 29.

Spring tongues 49 are provided on the housing 29 for releasably locking the sleeve 31 in attaching position on the front end portion 33. The spring tongues 49 have stop shoulders 51 at the end of the tongues that project outwardly and prevent passage of the sleeve 31 unless the spring tongues 49 are manually depressed.

Sleeve 31 is mounted on housing 15 and is adapted for sliding back and forth between end stop shoulders 45 and close the spring fingers 39 in attaching position when the sleeve 31 is at the front end portion 33 of the housing 29, and permit the spring fingers 39 to open when the sleeve 31 is at the rear end portion 35.

In operation, safety cap assembly 11 is attached to craft knife 13 by inserting blade 17 through the opening at the front end portion 33 and into cap housing 29 to its rear end portion 35, and then sliding sleeve 31 into attaching position at the front end portion 33 of cap housing 29, thereby depressing spring fingers 39 inwardly and pressing its inturned flanges 41 into groove 27 of handle 15. Safety cap assembly 11 is locked in its attaching position by stop shoulders 51 of spring tongues 49 which prevent cap assembly 11 from opening and being pulled off knife 15 accidentally.

To remove safety cap assembly 11 from craft knife 13, spring tongues 49 are pressed inwardly simultaneously towards one another so that stop shoulders 51 at the end of tongues 49 no longer block the passage of sleeve 31. The sleeve 31, with tongues 49 being depressed inwardly, is slid over the spring tongues 49 to the rear end portion 35 of the cap housing 29 thereby releasing the inturned flanges 41 of the spring fingers 39 from its grasp of handle 15 of the knife 13. In this unlocked and unattached position, the safety cap assembly 11 may be pulled off knife 13.

Safety cap assembly 11 has the advantage of being attachable to the rear end of the knife handle 15, when removed from the blade end, so as not to be lost when the knife is being used. A peripheral or circumferential groove 27, although it may be preferred, is not necessary for attachment.

I claim:

1. A safety cap assembly for a craft knife having a blade and a handle comprising a cap housing having a front end portion and a rear end portion with an opening at the end of the front end portion for receiving the knife blade, attaching means on the front end portion of the housing for attaching it to the knife handle, sleeve means mounted on the housing adapted for sliding back and forth between the front end and the rear end portions of the housing for closing the attaching means in attaching position when the sleeve means is at the front end portion of the housing and for opening the attaching means when the sleeve means is at the rear end portion, stop means at the ends of the housing for preventing the sleeve means from slipping off the housing, and safety-locking means on the housing for releasably locking the sleeve means in position on the front end portion when the sleeve means is closing the attaching means whereby to prevent the cap assembly from opening and being pulled off the knife accidentally.

2. The safety cap assembly of claim 1, said attaching means comprising spring fingers formed in the front end portion of the housing, and inturned flanges extending from the ends of the spring fingers and adapted to grasp the handle of the knife.

3. The safety cap assembly of claim 1, said sleeve means comprising an elongated sleeve made of synthetic plastic material and mounted on the housing.

4. The safety cap assembly of claim 1, said end stop means including stop shoulders extending outwardly from each end of the housing to prevent the sleeve from sliding off the housing.

5. The safety cap assembly of claim 1, said safety-locking means comprising a spring tongue in the rear end portion of the housing extending outwardly from the housing toward the front end portion, the end of the tongue forming a stop shoulder preventing passage of the sleeve unless the spring tongue is manually depressed.

6. A safety cap assembly for a craft knife having a blade, and a handle comprising a cap housing having a front end portion and a rear end portion with an opening at the end of the front end portion for receiving the knife blade, attaching means on the front end portion of the housing for attaching it to the knife handle, sleeve means mounted on the housing adapted for sliding back and forth between the front end and the rear end portions of the housing for closing the attaching means in attaching position when the sleeve means is at the front end portion of the housing and for opening the attaching means when the sleeve means is at the rear end portion, stop means at the ends of the housing for preventing the sleeve means from slipping off the housing, and safety-locking means on the housing for releasably locking the sleeve means in position on the front end portion when the sleeve is closing the attaching means whereby to prevent the cap assembly from opening and being pulled off the knife accidentally, said attaching means comprising spring fingers formed in the front end portion of the housing, and inturned flanges extending from the ends of the spring fingers and adapted to grasp the handle of the knife, said sleeve means comprising an elongated sleeve made of synthetic plastic material and mounted on the housing, said end stop means including stop shoulders extending outwardly from each end of the housing to prevent the sleeve from sliding off the housing, said safety-locking means comprising a spring tongue in the rear end portion of the housing extending outwardly from the housing toward the front end portion, and the end of the tongue forming a stop shoulder preventing passage of the sleeve unless the spring tongue is manually depressed.

7. A method of securing a safety cap assembly to a craft knife having a blade and a handle, said cap assembly having a housing with a front end portion and a rear end portion, said cap assembly including spring fingers on the front end portion of the housing and inturned flanges extending from the spring fingers for grasping the handle of the knife, a sleeve mounted on the housing, a spring tongue in the rear end portion of the housing extending outwardly from the housing toward the front end portion with a stop shoulder preventing passage of the sleeve unless the spring tongue is manually depressed, said method comprising attaching the cap assembly to the knife handle by depressing the spring fingers into contact with the knife handle by sliding the sleeve to the front end portion of the cap housing to close the spring fingers in attaching position, and releasably locking the sleeve in position on the front end portion by blocking the movement of the sleeve to the rear end portion of the cap housing with the shoulder of the depressible safety-lock spring tongue.

8. A method of removing a safety cap assembly from a craft knife having a blade and a handle, said cap assembly having a housing with a front end portion and a rear end portion, said cap assembly including spring fingers on the front end portion of the housing and inturned flanges extending from the spring fingers for grasping the handle of the knife, a sleeve mounted on the housing, a spring tongue in the rear end portion of the housing extending outwardly from the housing toward the front end portion with a stop shoulder preventing passage of the sleeve unless the spring tongue is manually depressed, said method comprising the steps of unlocking the sleeve mounted on the cap housing in attaching position at the front end portion of the housing by depressing the safety-locking spring tongue on the rear end portion of the cap housing, releasing the attaching spring fingers by sliding the sleeve to the rear end portion while the safety-locking spring tongue is depressed, and pulling the cap housing off the craft knife.

* * * * *